United States Patent [19]

Dickenson

[11] 4,372,125

[45] Feb. 8, 1983

[54] TURBINE BYPASS DESUPERHEATER CONTROL SYSTEM

[75] Inventor: Royston J. Dickenson, Scotia, N.Y.

[73] Assignee: General Electric Company, Schenectady, N.Y.

[21] Appl. No.: 218,765

[22] Filed: Dec. 22, 1980

[51] Int. Cl.[3] ..... F01K 13/02

[52] U.S. Cl. ..... 60/660; 60/653

[58] Field of Search ..... 60/653, 660, 662, 663, 60/666, 677

[56] References Cited

U.S. PATENT DOCUMENTS

| | | | |
|---|---|---|---|
| 3,919,846 | 11/1975 | Lecocq | 60/657 |
| 3,979,914 | 9/1976 | Weber | 60/653 X |
| 4,031,863 | 6/1977 | Läubli | 122/479 R |
| 4,214,451 | 7/1980 | Coombes et al. | 60/662 X |
| 4,274,259 | 6/1981 | Silvestri, Jr. | 60/653 X |

OTHER PUBLICATIONS vol. 35, *Proceedings of the American Power Conference*, "Bypass Stations for Better Coordination Between Steam Turbine and Steam Generator", P. Martin et al.

*Primary Examiner*—Allen M. Ostrager
*Assistant Examiner*—Stephen F. Husar
*Attorney, Agent, or Firm*—John F. Ahern

[57] ABSTRACT

An adaptive control system for controlling the temperature of desuperheated steam in a turbine bypass system. In one embodiment of the invention, redundant temperature sensors downstream of desuperheating water sprays provide an indication of the actual steam temperature after desuperheating has occurred. The highest value of temperature is automatically selected for control and to provide an error signal to a controller. The controller output, indicative of the deviation from a desired temperature, is multiplied by a factor proportional to steam flow in the bypass system. The multiplied signal is then utilized to proportionally position one or more water control valves to spray more or less water into the bypassed steam. The control system thus automatically adapts itself to variations in steam flow. Preferably, the steam flow is taken as the product of the position of a steam flow throttling valve in the bypass line and the steam supply pressure ahead of the valve. Additionally, operating parameters such as temperature and differential pressures are monitored and continuously compared against limiting values to provide automatic protection action if any of the conditions being monitored warrant such action.

11 Claims, 3 Drawing Figures

TURBINE BYPASS DESUPERHEATER CONTROL SYSTEM

BACKGROUND OF THE INVENTION

This invention relates to control systems for steam turbines and more particularly to control systems for desuperheating the steam bypassing the turbine in a turbine bypass system.

In the bypass mode of steam turbine operation, a bypass path is provided around the turbine or a section thereof to divert any excess steam from the turbine that is not required to sustain its load. There are a number of expected advantages in this mode of operation, and although not widely used in this country in the past, there is an increasing interest on the part of electrical utility companies in operating their power generating facilities in this manner.

Contrasted with the more conventional mode of operation wherein the steam generator produces only that amount of steam required by the turbine, the bypass mode allows the boiler, or steam generator, to be operated independently of the turbine. The boiler may in fact be operated at essentially constant steam flow and pressure regardless of the load demand on the turbine. Any excess steam is simply fed to the bypass subsystem. Depending on the turbine and the section thereof being bypassed, the bypassed steam is routed to a condenser for recovery and recirculation as feed water to the boiler or to a reheater section of the boiler for subsequent passage to other sections of the turbine. In general, steam bypassed and that utilized by the turbine are combined in the same receiving unit, whether condenser or reheater.

It is apparent in considering this mode of operation, that the quantity of steam being bypassed varies considerably from time to time depending on turbine operation. Thus the bypass lines are expected to handle rather large quantities of steam when turbine load is low and to handle intermediate to zero amounts as load on the turbine is increased. Steam from the boiler passing to either the bypass subsystem or to the turbine, of course, contains a considerable store of energy in the form of superheat. Of the steam passing into the turbine, much of the superheat is expended as energy is extracted to drive the turbine. On the other hand, bypassed steam must also be desuperheated to substantially the same extent if overheating damage to the steam receiver (reheater or condenser) or subsequent sections of the turbine is to be avoided. The bypassed steam must be conditioned to have substantially the same impact on the receiving unit as steam received from the turbine.

An effective and practical method of desuperheating steam in a turbine bypass system is to spray liquid water into the steam to reduce its temperature. With the bypass system designed to accept up to 100% of the turbine flow, however, a problem results from the fact mentioned above, that the quantity of steam flowing in the bypass lines varies considerably with turbine operation. Although feedback control systems in which downstream steam temperature is determined and the water spray adjusted accordingly might be expected to provide satisfactory results, this is not the case. Feedback control, although effective over a narrow range of steam flow conditions, does not provide uniform control over the full range of bypass steam flow conditions. For example, a control loop making use of a conventional proportional-integral-derivative controller requires retuning with each sizable change in steam flow. This is simply not practical with the ever-changing steam flow which larger bypass systems are expected to contend with.

It is, therefore, a principal object of the present invention to provide an adaptive control system for a steam turbine bypass system which automatically adapts itself to changing steam flow conditions and which is capable of maintaining substantially uniform temperature control over the full range of anticipated steam flow conditions.

It is a further object of the invention to provide such adaptive control system with automatic protection against malfunctions in the desuperheating apparatus which tend to produce overheating or water induction.

Still further objects of the invention will become apparent from the ensuing description.

SUMMARY OF THE INVENTION

In a preferred embodiment of the invention, multiple redundant temperature sensors downstream of the desuperheating water sprays provide an indication of the actual steam temperature after desuperheating has occurred. The highest value of sensed temperature is automatically selected for control and is compared with a preselected setpoint value to provide an error signal input to a controller. The controller output, indicative of the deviation from the desired temperature value, is amplified or multiplied by a factor proportional to steam flow in the bypass line to provide a steam flow rate conditioned signal. This conditioned signal, applied through appropriate valve positioning devices proportionally positions one or more water control valves to spray more or less water into the bypassed steam. The control loop thus automatically adapts to variations in steam flow rate. If the steam flow throttling valve is a position feedback, linear control valve, controlled by upstream pressure, it is preferable to take the steam flow signal as the product of valve position and pressure of the steam being supplied to the valve. This preferred arrangement avoids the need for additional sensors.

To guard against excessive temperatures and damage from water induction such as might occur should water be allowed to spray unnecessarily into the bypass lines, operating parameters such as temperature and differential pressures are monitored and continuously compared against limiting values. For example, transport lag resulting from very low steam conditions in the bypass system is guarded against by continuously monitoring the difference in boiler steam pressure and reheater steam pressure. Such pressure signals are ordinarily available in an auxiliary pressure control system so that, as pointed out above, additional sensing devices are not required. Protective action is automatically provided if any of the conditions being monitored warrant such action.

BRIEF DESCRIPTION OF THE DRAWINGS

While the specification concludes with claims particularly pointing out and distinctly claiming the subject matter regarded as the invention, the invention will be better understood from the following description taken in connection with the accompanying drawings in which:

DETAILED DESCRIPTION OF THE INVENTION

The operating environment and general principles of the invention can best be explained by reference to FIG. 1 which sets forth in schematic form an electrical power plant incorporating a steam turbine having bypass paths in which the bypassed steam is desired to be desuperheated. In describing and illustrating the invention in connection with FIG. 1, only those portions of the total turbine-generator system necessary to an understanding of the invention are presented and simplifications are made where possible to aid an understanding of the principles and operation of the invention.

Figure 1:
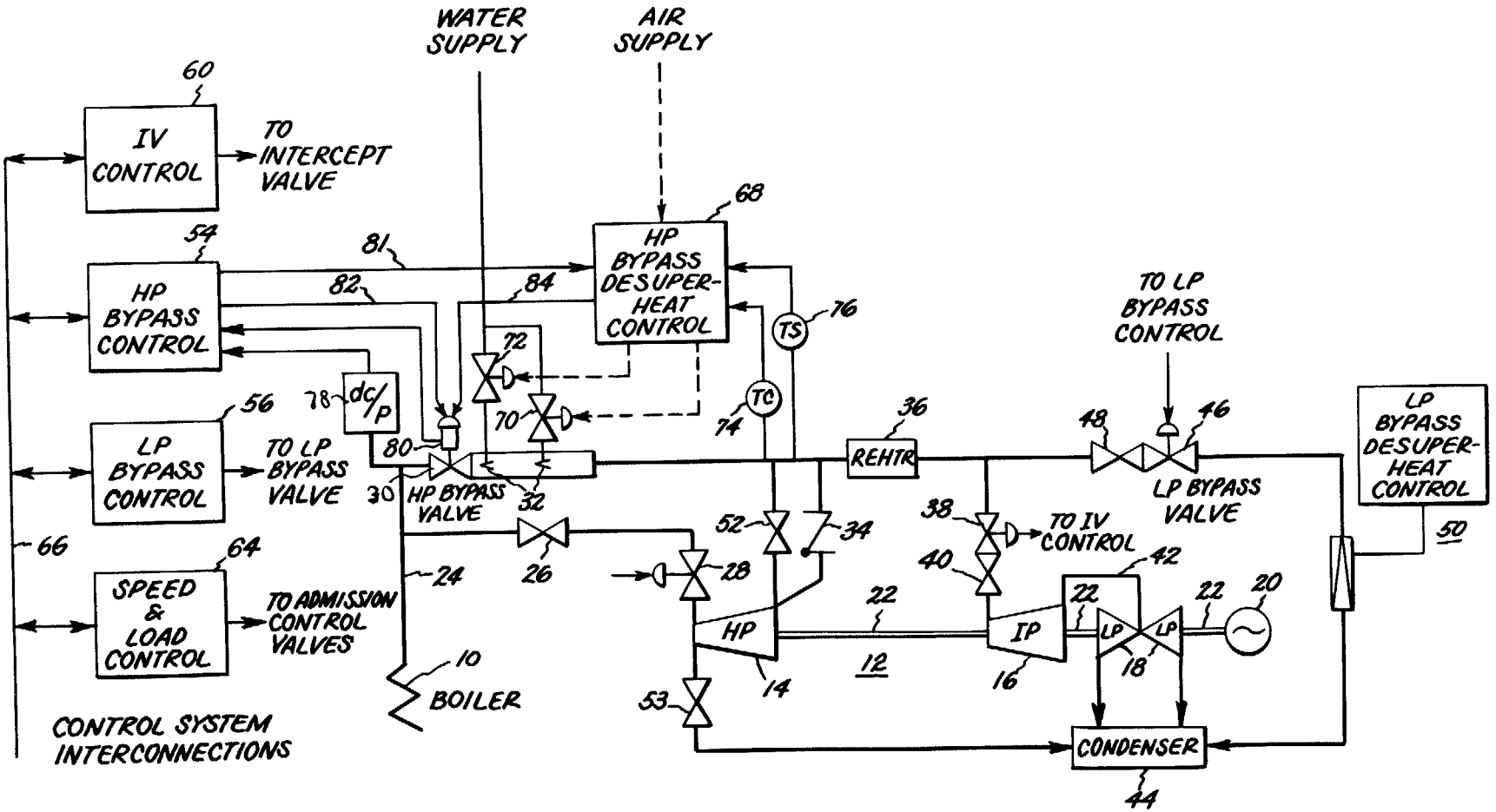
FIG. 1 is a simplified schematic diagram illustrating the operating environment of the invention, system interconnections, and the overall control function which the invention provides.

FIG. 1 shows an electrical power generating plant in which a boiler 10 provides the high pressure steam motive fluid to drive a reheat steam turbine 12 which includes high pressure (HP) section 14, intermediate pressure (IP) section 16, and low pressure (LP) section 18. Although this is conventional nomenclature, at times herein the IP section 16 and LP section 18 may be grouped together and referred to as the lower pressure (LP) sections of the turbine. In like manner, the bypass subsystem (described herein below) which passes steam around these sections may be referred to as the lower pressure or LP bypass subsystem. Although the turbine sections 14, 16, and 18 are illustrated as tandemly coupled to generator 20 by shaft 22, other coupling arrangements may be utilized.

The steam flow from boiler 10 is through steam conduit 24, from which steam may be taken to HP turbine 14 through main stop valve 26 and admission control valve 28. A high pressure bypass path including HP bypass valve 30 and desuperheating water sprays 32 provides an alternative or supplemental steam path around HP section 14. It will be recognized that, although one HP bypass subsystem is illustrated, other parallel bypass paths each including a flow control valve and desuperheating means such as water sprays 32 may also be utilized. In any case, steam flow exhausting from HP turbine 14 passes through check valve 34 to rejoin any bypassed steam and the total flow then passes through reheater 36. From reheater 36, steam may be taken through the intercept valve 38 and reheater stop valve 40 to the IP turbine 16 and LP turbine 18 which are series connected in the steam path by conduit 42. Steam exhausted from the LP turbine 18 flows to condenser 44. A lower pressure (LP) bypass subsystem including LP bypass valve 46, LP bypass stop valve 48, and desuperheating station 50 provides an alternative or supplemental steam path around IP turbine 16 and LP turbine 18 to condenser 44.

Associated with the HP section 14, and principally used for no-load and low-load operating conditions, are reverse flow valve 52 and ventilator valve 53. These valves, 52 and 53, are used to provide a reverse flow of steam through the HP turbine in the manner disclosed and claimed in U.S. patent application Ser. No. 105,019 which is assigned to the assignee of the instant invention and whose disclosure is herein incorporated by reference. It is sufficient to note here that the reverse steam flow passes from the HP bypass path through reverse flow valve 52, backwards through HP section 14, through ventilator valve 53, and then to the condenser 44. This reverse steam flow eliminates rotation loss (windage loss) heating which occurs under certain low-load conditions of the type associated with the bypass mode of operation. Thus the reverse flow pattern is used mostly for turbine startup during which forward flow of steam through IP section 16 and LP section 18 is used to drive the turbine as steam admission control valve 28 is held closed. It is to be noted that although admission control valve 28 is referred to herein as a single valve for the purpose of explaining the invention, in actual practice, as is well known, a plurality of control valves are used to achieve either full or partial arc admission of steam to the turbine 12.

During operation, it is desirable that steam flow in conduit 24 be substantially constant and that steam pressure therein be under a prescribed control regime. It is apparent that, if steam flow in conduit 24 is to remain constant as turbine load varies, then the high-pressure bypass system must absorb the difference in steam flow. Thus, for example, as the turbine 12 undergoes a load change of zero to 100% of its load capacity, the bypass steam flow is expected to vary inversely from 100% down to zero. Under this latter condition HP bypass valve 30 is completely closed. The significant point is that the amount of bypassed steam which must be desuperheated varies considerably during turbine operation. As was pointed out above, desuperheating is necessary to protect the reheater 36, downstream turbine section 16, and the HP turbine 14 (when in the reverse flow mode) from high temperature impact. In effect, desuperheating has the same deenergizing effect on bypassed steam as does HP section 14 on turbine directed steam so that bypassed and turbine utilized steam have the same downstream impact. The control system of the present invention is automatically adaptive to these widely varying steam flows so that quick and precise steam temperature control is uniformly attained. However, further description of elements of the total turbine control system will be helpful to set the present invention in proper prospective.

To control system for a large steam turbine such as that illustrated in FIG. 1 is, of necessity, a very complex and complicated arrangement. However, an understanding of such a control system in its entirety is not necessary for an understanding of the present invention and it will be sufficient to describe only those control loops of the total system having a direct bearing on the present invention. For example, in both the HP and LP bypass lines, steam flow is controlled by throttling bypass valves 30 and 46, respectively, and preferably in a manner related to boiler steam flow and pressure. Accordingly, FIG. 1 illustrates feedback control loops directed to this purpose and therefore includes HP bypass controller 54 and LP bypass controller 56. Other related control loops include intercept valve controller 60 and speed/load controller 64. Control of the intercept valve 38 is preferably related to reheater steam pressure and admission control valve position; admission control valve 28 is positioned to maintain speed and load control of the turbine 12. All control functions are carried out in coordinated fashion to maintain operating variables at preselected setpoint values or within preselected limits. In FIG. 1, line 66 schematically illustrates the interconnection and exchange of signals between the various control loops. It will be recognized, of course, that various operating parameters such as turbine speed, boiler pressure, etc. are taken into the total control system for both control and monitoring purposes. Many of these input signals are not specifically illustrated in FIG. 1 since they are without direct bearing on the present invention.

A comprehensive control system for a bypass steam turbine which is usable in connection with the present invention is that described and claimed in co-pending U.S. patent application Ser. No. 184,359 which is of common assignee and inventorship with the instant invention and whose disclosure is incorporated herein by reference thereto.

With continued reference to FIG. 1, a desuperheating control system for control of the HP bypassed steam will now be described. It is to be recognized, however, that the present invention may also be embodied in LP desuperheating station 50. In general, however, the control requirements for an LP bypass system are less demanding and a more conventional control system may be utilized in many cases with satisfactory results.

High pressure bypass desuperheater controller 68 positions water/flow control valves 70 and 72 to spray more or less water into the HP bypassed steam depending on the temperature of the desuperheated steam as sensed downstream by steam temperature sensor 74. Preferably, redundant temperature sensors are utilized for utmost reliability. Temperature sensing switch 76 is responsive to detect both extremely high and extremely low steam temperature and provides input signals indicative of such conditions to controller 68. Preferably, temperature sensing switches, such as switch 76, are also redundantly provided.

The instantaneous rate of steam flow in the HP bypass line is utilized to adapt the desuperheating control system to changing conditions and this information is contained in knowledge of the input steam pressure which is sensed by pressure transducer 78 and the relative degree of opening (position) of HP bypass valve 30 which is sensed by valve position transducer 80. In the embodiment of the invention illustrated, these signals are inputs to HP bypass control 54 wherein they are utilized for pressure control purposes. However, the estimated steam flow, based on these signals, is returned to desuperheat control 68 along line 81. Thus, one advantage of the present invention (i.e., the use of otherwise available sensing devices) is apparent. It will be clear that, in other forms of the invention, these signals may be taken directly to desuperheat control 68. The HP bypass valve 30, of course, is normally positioned in accord with a control signal supplied by HP bypass controller 54 along line 82. However, a protection portion of desuperheater controller 68 supplies a valve closing signal along line 84 to rapidly close the HP bypass valve 30 in the event of certain extreme conditions as will be more fully discussed herein below. Preferably, water control valve 70 and 72 are pneumatically operated. Accordingly, an air supply is furnished to desuperheating controller 68 which controls the air pressure applied to valves 70 and 72.

Figure 2:
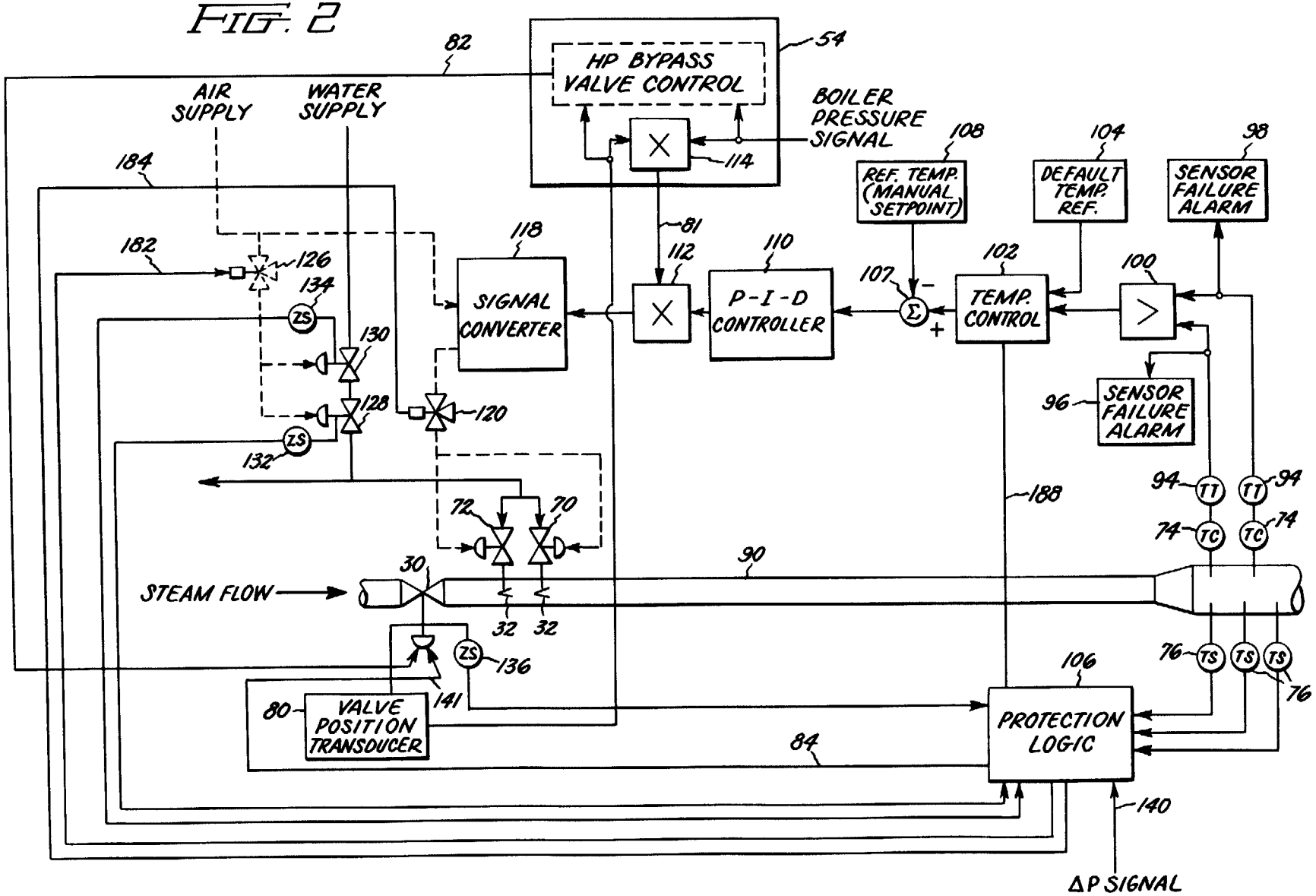
FIG. 2 is a block diagram illustration of a preferred embodiment of the invention.

FIG. 2 illustrates in greater detail a bypass desuperheating control system according to the present invention. In FIG. 2, only that part of the HP bypass line necessary to an explanation of the invention is shown. Components common to both FIGS. 1 and 2 are identically designated. Steam flow entering the HP bypass line 90 through HP bypass valve 30 is desuperheated by the addition of water through desuperheating means in the form of water sprays 32. Downstream of the spray units 32 at a distance sufficient to allow complete vaporization of the liquid water, redundant temperature sensing units 74 respond to the desuperheated steam temperature and provide representative signals to signal transmitters 94, also redundantly provided. Each sensor loop is provided with a sensor failure alarm, 96 and 98, to alert operating personnel that the associated loop is out of service. Preferably, the sensor loops, comprising sensors 74 and transmitters 94, are of the type known in the art in which a continuous current is circulated to indicate an active condition. Each temperature signal is applied as an input signal to high-value gate 100 which automatically selects the highest sensed temperature as the temperature which is to be controlled. This selection provides a measure of protection against excessively high temperatures since the higher value is always presumed the valid temperature.

Temperature selector 102 selects either the bypass steam temperature signal from low value gate 100 or a default temperature value supplied by reference supply 104. The selection depends on a status control signal supplied by protection logic 106 which will be more fully described hereinbelow. The selected temperature (which will be the actual steam temperature signal under normal operating conditions) signal is applied to summing junction 107 and an error signal is produced by summing the temperature signal against a desired, preselected setpoint temperature 108. The error signal is applied to a conventional three mode proportional-integral-derivative (P-I-D) controller 110 which acts on the error signal to produce an output signal in accord with the tuning of controller 110. It will be appreciated by those of ordinary skill in the art that the output signal of controller 110 is of such form that it would tend to correctly position water flow control valve 70 and 72 to maintain the temperature of the desuperheated steam at the setpoint valve supplied by reference unit 108. It will further be recognized by those skilled in the art that P-I-D controller 110, acting alone, will be deficient in quickly and accurately positioning valves 70 and 72 except under a rather narrow range of steam flow conditions for which it had been tuned. To automatically adapt the control loop to changing steam conditions, a second control element in the form of a first multiplier 112 alters the corrective action signal from controller 110 by multiplying such signal by a signal representative of the rate of steam flow in the HP bypass line 90. Preferably, the steam flow rate signal is provided as the product of boiler steam pressure and a signal representative of the degree of opening of HP bypass valve 30. Thus, in FIG. 2, second multiplier unit 114 provides an output signal to first multiplier 112 which is the product of boiler pressure (the boiler pressure signal is obtained, for example, from transducer 78 of FIG. 1) and valve stroke obtained from valve position transducer 80. Second multiplier 114 may advantageously be located in HP bypass control 54 as illustrated to utilize steam pressure and valve position signals otherwise used in the HP bypass control 54. In this fashion, available signals may be utilized without the need for added sensing devices. Regardless of the specific signal source, amplifying the corrective action signal from controller 110 by a factor proportional to the steam flow has been found to produce very uniform temperature control, free of transient effects due to widely varying steam flow rates.

In FIG. 2, the adapted control signal from multiplier 112 is applied to a signal converter unit 118, which is of conventional design, to proportionally regulate a supply of air to valves 70 and 72 so they are positioned accordingly. Pneumatically actuated valves are preferred for water flow control valves 70 and 72 because they impose less burden on the hydraulic system which is used to operate other turbine valves and because of their inherent fail-safe nature. A block valve 120 with which the air supply to valves 70 and 72 can be cut off will be discussed in connection with the protection portion of the control system.

The protection portion of the control system includes the following actions to guard against the harmful effects of a malfunction:

(a) A high temperature trip of the HP bypass valve 30 to protect against insufficient water, delayed to ride through normal transients.

(b) A low temperature trip of the HP bypass valves to protect against water induction, automatically reset after a preset, short time period.

(c) A selection of the default temperature reference (lower than the setpoint 108) if all the water block valves are not open due to their malfunction, the HP bypass valve 30 is open less than a predetermined amount (protects against poor low-flow desuperheating) or when the difference between the boiler pressure and reheater pressure is excessively low (protects against excessive transport lag).

(d) Closure of water spray block valves whenever HP bypass valve 30 is open less than a predetermined amount or has been tripped closed, or the HP bypass steam temperature is too low.

(e) A delayed trip of the HP bypass valve 30 if the water block valves are open and the default temperature reference 104 is selected (protects against sticking water block valves).

The protection subsystem includes protection logic 106 which receives indications of either excessively high or low desuperheated steam from temperature sensing switches 76; air block valves 120 and 126; water block valves 128 and 130; and valve position switches 132, 134, and 136. Additionally, protection logic 106 receives a signal indicative of the difference in pressure between the boiler pressure and the reheater steam pressure representing first and second locations in the steam path. The differential pressure signal is received at input 140 and provides a valve trip signal to the HP bypass valve 30 along line 84 should the difference in pressures become less than a preselected amount. The differential pressure signal is obtainable from pressure signals available from HP bypass control 54 and LP bypass control 56, both of FIG. 1.

Figure 3:
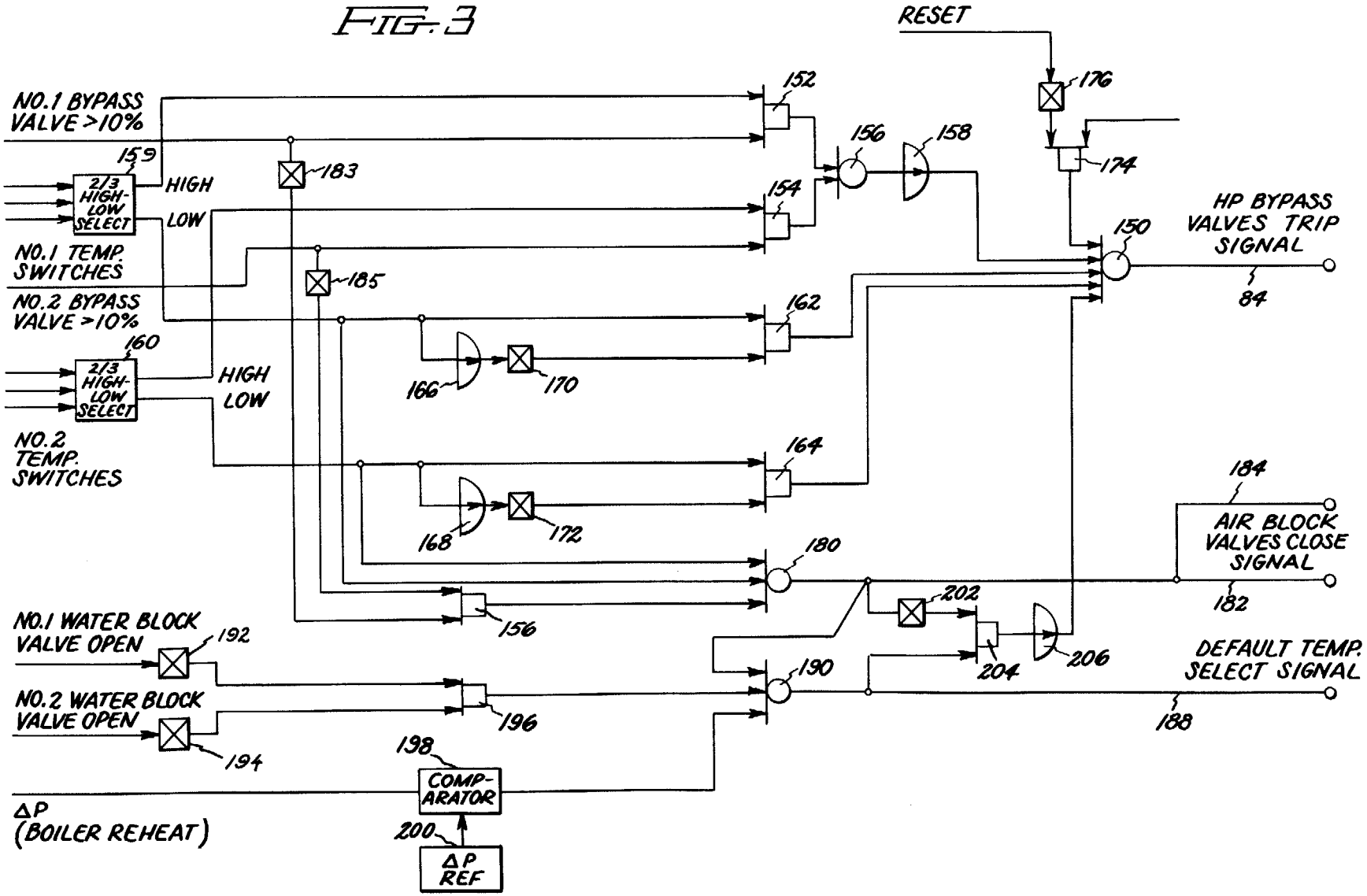
FIG. 3 is a schematic diagram of the protection logic of FIG. 2 provided in one form of the invention.

FIG. 3 shows in detail a preferred configuration for the protection logic 106 of FIG. 2. It is to be noted that the logic network of FIG. 2 is operable for protection of two parallel HP bypass systems around a single HP bypass section of a turbine. For convenience, therefore, the bypass paths are referred to in connection with FIG. 3 as Number 1 bypass and Number 2 bypass. The logic symbols of FIG. 3 are standard NEMA logic symbols.

The HP bypass valves (for parallel bypass lines) are tripped closed upon receipt of a signal from OR gate 150 along line 84, identical with line 84 of FIGS. 1 and 2. AND gates 152 and 154, OR gate 156, and time delay 158 provide a time delayed trip of the HP bypass valves in the event either HP bypass valve is greater than a predetermined low position (this, of course, may be varied to other degrees of opening) and the steam temperature is excessive as determined by 2 out of 3 high-low temperature selectors 159 and 160. Temperature selectors 159 and 160 have inputs from temperature switches such as switches 76 of FIG. 2 and provide outputs indicative of either excessively high or excessively low temperatures. AND gates 162 and 164 along with time delays 166 and 168 and inverters 170 and 172 provide resetable triggers which actuate OR gate 150 upon detection of excessively low desuperheated steam temperature. These triggers automatically reset themselves following a preset time period after the temperature drops below the low setpoint. A latch network to hold OR gate 150 in its activated state once it has been triggered is formed from AND gate 174 and inverter 176. If the trip condition is cleared, a reset signal into inverter 176 will clear the latch.

Air block valves, such as valves 120 and 126 of FIG. 1 are forced closed by signal from the triggering of OR gate 180. The closing signal is provided on lines 182 and 184. OR gate 180 is triggered by low temperature desuperheated steam in either HP bypass line or if the HP bypass valves in both HP bypass lines are open less than a preselected amount. These latter conditions are recognized by inverters 183 and 185 and AND gate 186.

It will be recalled that under certain conditions it becomes desirable that a default temperature be utilized by the control system rather than the actual temperature of the desuperheated steam. Thus, in FIG. 2, default temperature reference 104 is selected as the control signal to summing junction 107 upon command from protection logic 106. This is to prevent water induction in the HP bypass steam lines.

With reference to FIG. 3, the default temperature select signal is provided on line 188 by OR gate 190. OR gate 190 in turn is triggered if water block valves such as 128 and 130 of FIG. 2 are both less than fully open satisfying inverters 192 and 194 and AND gate 196; if the differential pressure between the boiler and reheater is less than a preselected amount as determined by comparator 198 which receives the $\Delta P$ signal on line 140 and a comparison value from reference unit 200; or if all air block valves are demanded closed by OR gate 180. As an example, OR gate 190 may be triggered to select the default temperature if the differential pressure value becomes too low.

The protection network 106 of FIG. 2 also includes inverter 202, AND gate 204, and time delay 206 which together trigger OR gate 150 following a fixed time delay if the default temperature reference is selected and the air block valves are demanded open.

Therefore, while the foregoing has shown and described what is considered to be a preferred embodiment of the invention, it is understood that various other modifications may be made therein. For example, although steam flow rate in the controlled bypass line is preferably taken as the product of steam pressure and valve position it will be recognized that other measures of steam flow rate may also be utilized. It is intended to claim all such modifications which fall within the true spirit and scope of the present invention.

What is claimed is:

1. In combination with a steam turbine having a bypass system for diverting excess steam supplied by a steam generator from the turbine and including means for desuperheating the bypassed steam and at least one steam flow control valve, a steam desuperheater control system for controlling the temperature of desuperheated steam, comprising:

temperature determining means providing a representation of the temperature of the desuperheated steam;

first control means operatively connected to said desuperheating means and responsive to said temperature representation to provide corrective action to said desuperheating means tending to maintain the temperature of the desuperheated steam at a preselected temperature reference value;

steam flow determining means providing a representation of steam flow rate in said bypass subsystem; and second control means responsive to said steam flow representation and interactive with said first control means to alter said corrective action as a function of steam flow rate in said bypass subsystem.

2. The combination of claim 1 wherein said steam flow determining means is a multiplier providing said steam flow representation as the product of steam pressure being supplied to said bypass system and the degree of opening of said steam flow control valve.

3. The combination of claim 1 wherein said second control means is a multiplier adapted to alter the corrective action of said first control means by a factor proportional to said flow representation.

4. The combination of claim 2 wherein said second control means is a multiplier altering the corrective action of said first control means by a factor proportional to said steam flow representation.

5. The combination of claims 1, 2, 3, or 4 wherein said control system includes a protection subsystem responsive to bypass system operating parameters in excess of preselected values thereof by providing protective action operative to control excessive steam temperatures and liquid water induction in said bypass system.

6. The combination of claim 5 wherein said temperature determining means is redundantly provided and said control system further includes;

a high-value selector for automatically selecting the highest value of redundantly provided representations of steam temperature;

a default temperature reference representing a preselected steam temperature value;

a temperature selector responsive to said protection subsystem to automatically select said highest value representation of temperature or said default temperature as demanded by said protective action.

7. The combination of claim 6 wherein said protection subsystem includes;

a temperature sensing switch providing a first response to a preselected high temperature of desuperheated steam and a second response to a preselected low temperature of desuperheated steam;

a valve position sensor responsive to the degree of opening of said steam flow control valve to provide a signal indicative that said valve is open in excess of a preselected amount; and logic means for rapidly closing said steam flow control valve whenever said first response is received and said steam flow control valve is open in excess of said preselected amount or whenever said second temperature response is received.

8. The combination of claim 7 wherein said protection subsystem includes;

means providing a representation of differential steam pressure between a first steam path location and a second steam path location; and logic means for selecting said default temperature whenever said differential pressure representation exceeds a preselected reference value.

9. An adaptive control system for controlling the desuperheating of steam flowing in the steam bypass system of a steam turbine and wherein said bypass system includes a steam flow control valve, said control system comprising:

spraying means to spray liquid water into said bypass flow of steam to provide desuperheating thereof;

means responsive to a control signal to adjust the water flow rate to said spraying means;

temperature sensing means downstream of said water spray means providing a temperature signal indicative of the temperature of desuperheated steam;

first control means responsive to said temperature signal to produce a corrective signal tending to cause said water flow adjust means to adjust water flow in a manner tending to maintain a preselected temperature of desuperheated steam;

steam flow sensing means providing a signal indicative of desuperheated steam flow rate; and second control means responsive to said steam flow rate signal and to said corrective signal to produce said water adjust control signal as the product of said steam flow rate signal and said corrective signal.

10. The control system of claim 9 wherein said steam flow sensing means comprises a multiplier providing said signal indicative of desuperheated steam flow rate as the produce of a signal representative of pressure of steam supplied to said bypass system and a signal representative of the degree of opening of said steam flow control valve.

11. The control system of claim 9 or claim 10 wherein said control system further includes a protection subsystem responsive to bypass system operating parameters in excess of preselected values or said parameters by providing protective action operative to control excessive steam temperature and liquid water induction in said bypass system.

* * * * *